US005893248A

United States Patent [19]

Béliveau

[11] Patent Number: 5,893,248

[45] Date of Patent: Apr. 13, 1999

[54] INSULATING PANEL AND METHOD FOR BUILDING AND INSULATING A CEILING STRUCTURE

[76] Inventor: Jean-Louis Béliveau, 1485 chemin Georgesville, Magog, Canada, J1X 3W4

[21] Appl. No.: 08/888,921

[22] Filed: Jul. 7, 1997

Related U.S. Application Data

[62] Division of application No. 08/710,532, Sep. 19, 1996.

[51] Int. Cl.[6] ..... E04C 1/41

[52] U.S. Cl. ..... 52/309.7; 52/309.2; 52/309.16; 52/787.11; 52/746.11

[58] Field of Search ..... 52/309.12, 309.7, 52/309.3, 506.02–506.05, 600, 509, 787.11, 309.16, 746.11, 309.1, 309.2, 364, 344

[56] References Cited

U.S. PATENT DOCUMENTS

| | | | |
|---|---|---|---|
| 1,642,088 | 9/1927 | Scarff | 52/746.11 X |
| 3,313,073 | 4/1967 | Mathews . | |
| 3,401,494 | 9/1968 | Anderson . | |
| 3,410,044 | 11/1968 | Moog . | |
| 3,449,879 | 6/1969 | Bloom . | |
| 4,069,632 | 1/1978 | Bode et al. . | |
| 4,163,349 | 8/1979 | Smith . | |
| 4,320,604 | 3/1982 | O'Hanlon . | |
| 4,438,611 | 3/1984 | Bryant | 52/309.2 |
| 4,885,887 | 12/1989 | Simmons et al. | 52/410 |
| 4,920,722 | 5/1990 | Bosi . | |
| 4,961,298 | 10/1990 | Nogradi | 52/235 |
| 5,129,628 | 7/1992 | Vesper | 256/31 |
| 5,524,400 | 6/1996 | Schmechel | 52/474 |
| 5,722,198 | 3/1998 | Bader | 52/745.09 |
| 5,799,462 | 9/1998 | McKinney | 52/309.7 |

FOREIGN PATENT DOCUMENTS

| | | |
|---|---|---|
| 19074 | 9/1912 | Canada . |
| 1047730 | 7/1979 | Canada . |
| 1116371 | 8/1982 | Canada . |
| 1208871 | 4/1986 | Canada . |

*Primary Examiner*—Christopher Kent
*Assistant Examiner*—Yvonne Horton-Richardson
*Attorney, Agent, or Firm*—Robic

[57] ABSTRACT

The insulating panel for a building structure has a rigid insulating body and two opposed outer surfaces. It is characterized in that it comprises a plurality of framing members made of a high strength material embedded in the body, each framing member being provided with anchor means for securely holding it in the body and being adapted for receiving and holding at least one fastener and thereby securing the panel to the building structure. An insulating panel according to the present invention, on one hand allows a very large range of use for such a panel, and on the other hand, allows a very rapid installation at a low cost. Such an insulating panel may be used for insulating a wall as well as a ceiling or a roof or a floor.

14 Claims, 4 Drawing Sheets

INSULATING PANEL AND METHOD FOR BUILDING AND INSULATING A CEILING STRUCTURE

This is a division of my co-pending U.S. patent application Ser. No. 08/710,532 filed on Sep. 19, 1996.

FIELD OF THE INVENTION

This invention relates to building insulations and more particularly to an insulating panel and an insulating ceiling structure for a building. It also relates to a method for building and insulating a ceiling, a wall, a roof or a floor.

BACKGROUND OF THE INVENTION

Different techniques and products already exist in the prior art for insulating buildings. By insulation, we mean thermal insulation as well as sound insulation. In general, the techniques and products used depend mostly on the structure to be insulated and are specifically adapted to either wall insulations, ceiling insulations, floor insulations or roof insulations. For example, the rigid insulating panels known in the prior art, are mainly used for wall insulations. In order to secure those panels to a wall, these panels have a surface provided with parallel grooves in which a framing member may be inserted as the panel is installed against the wall. The panels are then secured to the wall by means of screws. A drawback with this type of panel is that the time required for its installation is very long and it is thus very expensive. Another drawback is that the fasteners, for example, the screws, act as direct thermal bridges between the outside and the inside. Thus, these panels do not allow a uniform insulation of the surface to be insulated.

Moreover, these types of insulating panels are not adapted to insulate ceilings because their structure is not adapted for securing or hanging any object under the ceiling. This is one of the reasons why the insulating panels known in the prior art, are not commonly used for insulating ceilings.

For the foregoing reasons, there is a need in the construction of buildings for a universal product that may be efficiently used for insulating either a wall, a ceiling, a roof or a floor, and this, at a low cost.

SUMMARY OF THE INVENTION

The present invention is directed to a product that satisfies these needs. More particularly, an object of the present invention is to propose an insulating panel for a building structure, the panel having a rigid insulating body and two opposed outer surfaces and comprising a plurality of framing members made of a high strength material embedded in said body, each framing member being provided with anchor means for securely holding it in the body and being adapted for receiving and holding at least one fastener and thereby securing the panel to the building structure.

Preferably, each of the framing members has a bottom surface flush with one of the outer surfaces of the panel.

More particularly, the present invention proposes an insulating panel for a building structure, the panel comprising:

a rigid body made of thermoplastic foam;

two opposed outer surfaces; and a plurality of spaced-apart elongated framing members embedded in said body, each framing member having a U-shaped cross-section with a bottom surface parallel to both said outer surfaces and interconnecting a pair of oppositely disposed arms extending into the body, each of said arms being provided along the framing member with a plurality of holes filled with foam of the body and thereby anchoring said framing member in said body; and each of said bottom surface being adapted along its length to receive and hold a plurality of fasteners to secure the panel to the building structure and to hang an object to the panel.

Another object of the present invention is to propose an insulating ceiling structure for extending under the load-bearing structure of a building, the insulating ceiling structure comprising:

a first layer of panels, as described hereinabove, the bottom surface of the framing members of each of the panels opposing the load-bearing structure; and a first set of fasteners for securing the panels of the first layer to the load-bearing structure via the framing members.

A third object of the present invention is to propose: a method for building and insulating a ceiling structure under the load-bearing structure of a building, the method comprising the step of:

a) fixing a first layer of insulating panels as described hereinabove, to the load-bearing structure, the bottom surface of the framing members of each of said panels opposing the load-bearing structure.

Advantageously, an insulating panel according to the present invention, allows a rapid, solid and easy installation of the panel to any vertical, horizontal or oblique structure. Thus, such an insulating panel may be used advantageously for a insulating any structure of a building, either the ceiling, the walls, the roof or the floors.

Another advantage of the present invention is that the embedded framing members in the body of the panel allows to easily secure any object, sheathing covering, etc. directly to the panel and that very firmly.

An unrestricted description of preferred embodiments will now be given with reference to the appended drawings.

DESCRIPTION OF PREFERRED EMBODIMENTS OF THE INVENTION

Insulating panel

Figure 1:
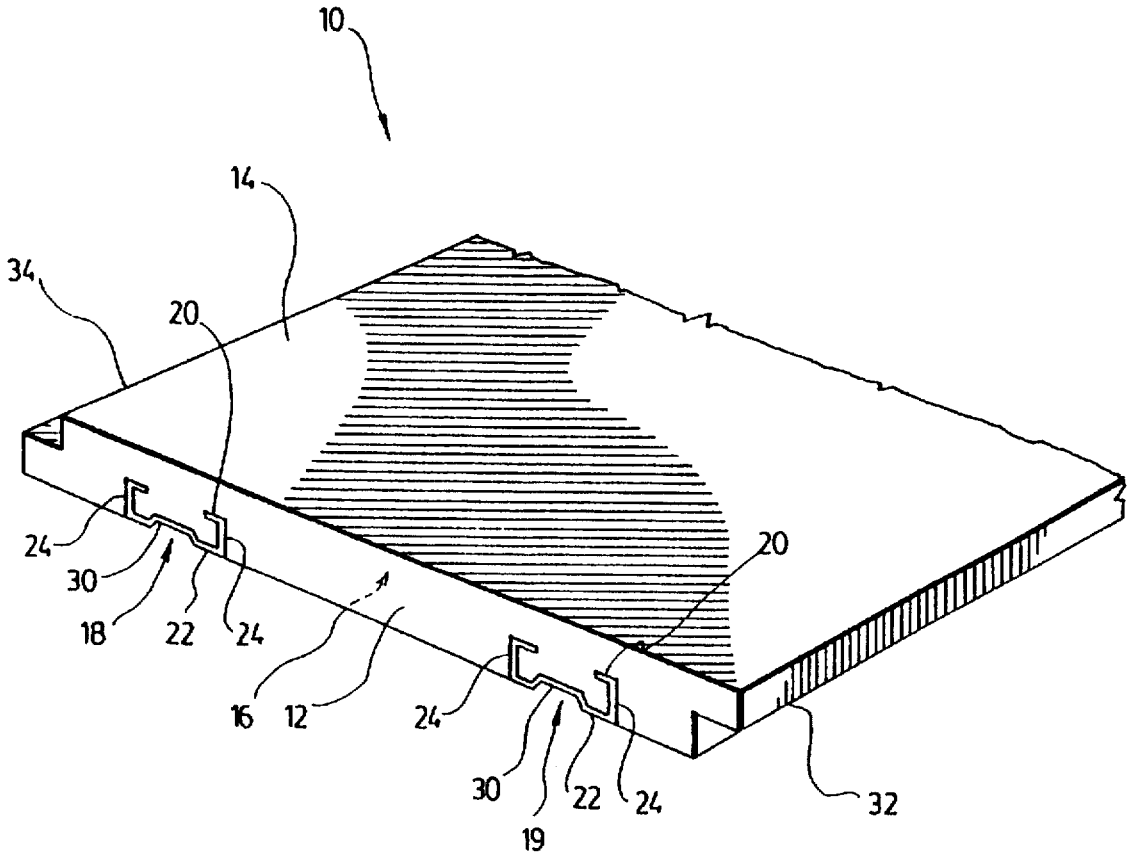
FIG. 1 is a perspective view of a preferred embodiment of an insulating panel according to the present invention.

Referring to FIG. 1, a preferred embodiment is shown therein of an insulating panel 10 for a building structure.

This insulating panel 10 is of the type having a rigid insulating body 12 and two opposed outer surfaces, an upper surface 14 and a bottom surface 16. Any type of rigid insulating material may be used for the construction of such a panel 10. Preferably, thermoplastic materials such as polystyrene, polyurethane, or polyethylene are used. This insulating panel 10 further comprises a plurality of framing members 18 embedded in the body 12 of the panel 10. Each of these framing members 18 preferably has a bottom surface flush with one of the outer surfaces of the panel 10. In the preferred embodiment illustrated in FIG. 1, these framing members 18 are flush with the bottom surface 16 of the panel 10. In other embodiments of the invention, the framing members 18 could have been completely integrated inside the body 12 of the panel 10, without departing from the scope of the present invention. The framing members 18 flush with a surface of the panel 10 as illustrated, merely makes the installation of the panels easier.

In another preferred embodiment of the invention (non illustrated), and mainly used for sound insulation, the panel comprises framing members flush with both outer surfaces of the panel. Thereby, the panel may be fixed to a structure without requiring the use of fasteners that go through the entire body of the panel, thereby allowing a maximal and uniform insulation of the structure.

The framing members 18 are preferably made of metal, but may also be made of wood or a rigid plastic, or any other high strength material allowing to securely hold metallic fasteners. As illustrated in FIG. 1, the framing members 18 are provided with anchoring means 20 for securely holding them in the body 12 of the panel 10.

Figure 2A:
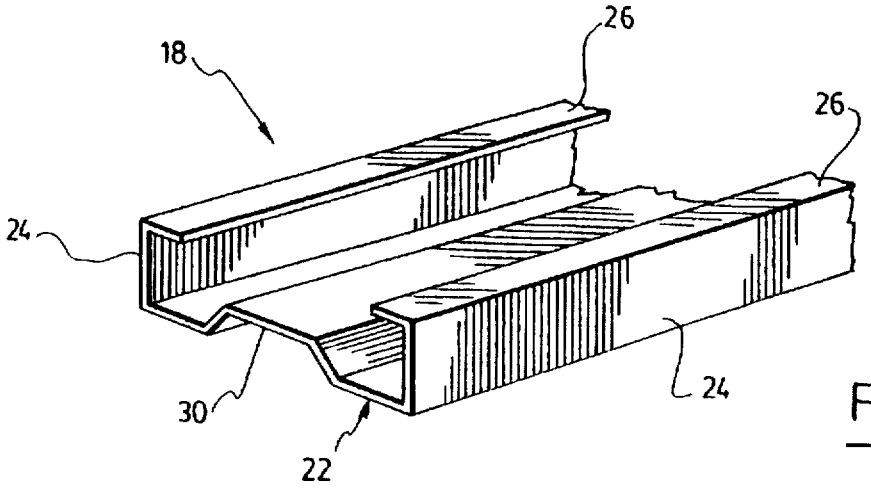
FIGS. 2*a*, 2*b* and 2*c* are each a perspective view of different versions of a framing member.
Figure 2B:
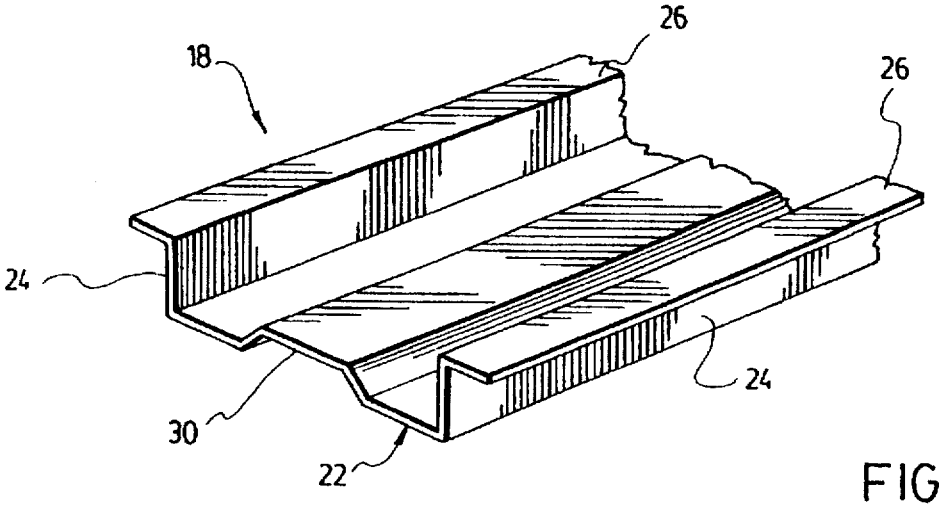
Figure 2C:
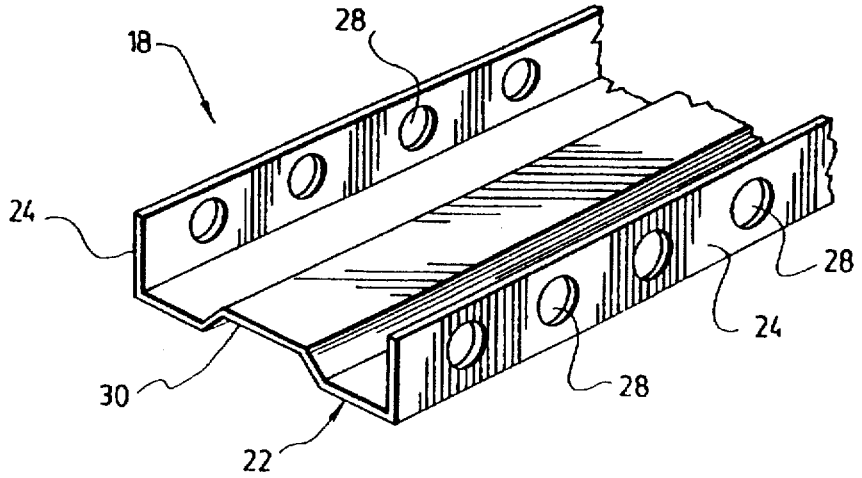

Referring to FIGS. 2*a*, 2*b*, and 2*c*, different versions of framing members 18 are shown. Each of the framing members 18 has a U-shaped cross-section, having two arms 24 extending into the body 12 of the panel, as shown in FIG. 1. As illustrated in FIGS. 2*a* and 2*b*, each of these arms 24 may be provided with angled ends, either towards the inside of the U-shaped cross-section (FIG. 2*a*) or towards the outside (FIG. 2*b*). In these two cases, the anchoring means 20 above-mentioned, are defined by these angled ends 26.

As illustrated in FIG. 2*c*, the anchoring means 20 may also be defined by a plurality of openings 28 provided in the arms 24 of the framing member 18.

Preferably, the bottom surface 22 of the framing member 18 is provided with an elongated slot 30 adapted to receive a fastener, for example the head of a screw (non-illustrated).

Obviously, the framing members 18 may have a different shape than the one described hereinabove. For example, they may consist of a metallic bar having a square cross-section and provided with a plurality of openings defining the anchoring means or by a framing member as described hereinabove, but having the end of each arm defining a hook. It could also be a wood bar having a trapezoidal cross-section.

An insulating panel according to the present invention may be provided with straight sides or, as illustrated in FIG. 1, these sides 32, 34, may have a shape allowing to adjacently fit two panels one within the other, thereby increasing the insulating capacity of a group of panels.

As can be appreciated, an insulating panel according to the present invention, on one hand allows a very large range of use for such a panel, and on the other hand, allows a very rapid installation at a low cost. In fact, an insulating panel according to the present invention may be used for insulating a wall as well as a ceiling or a roof or a floor.

The following description will now be more specifically directed to an insulating ceiling structure and to a method for insulating a ceiling with the panels described hereinbefore.

Insulating ceiling structure

Figure 3:
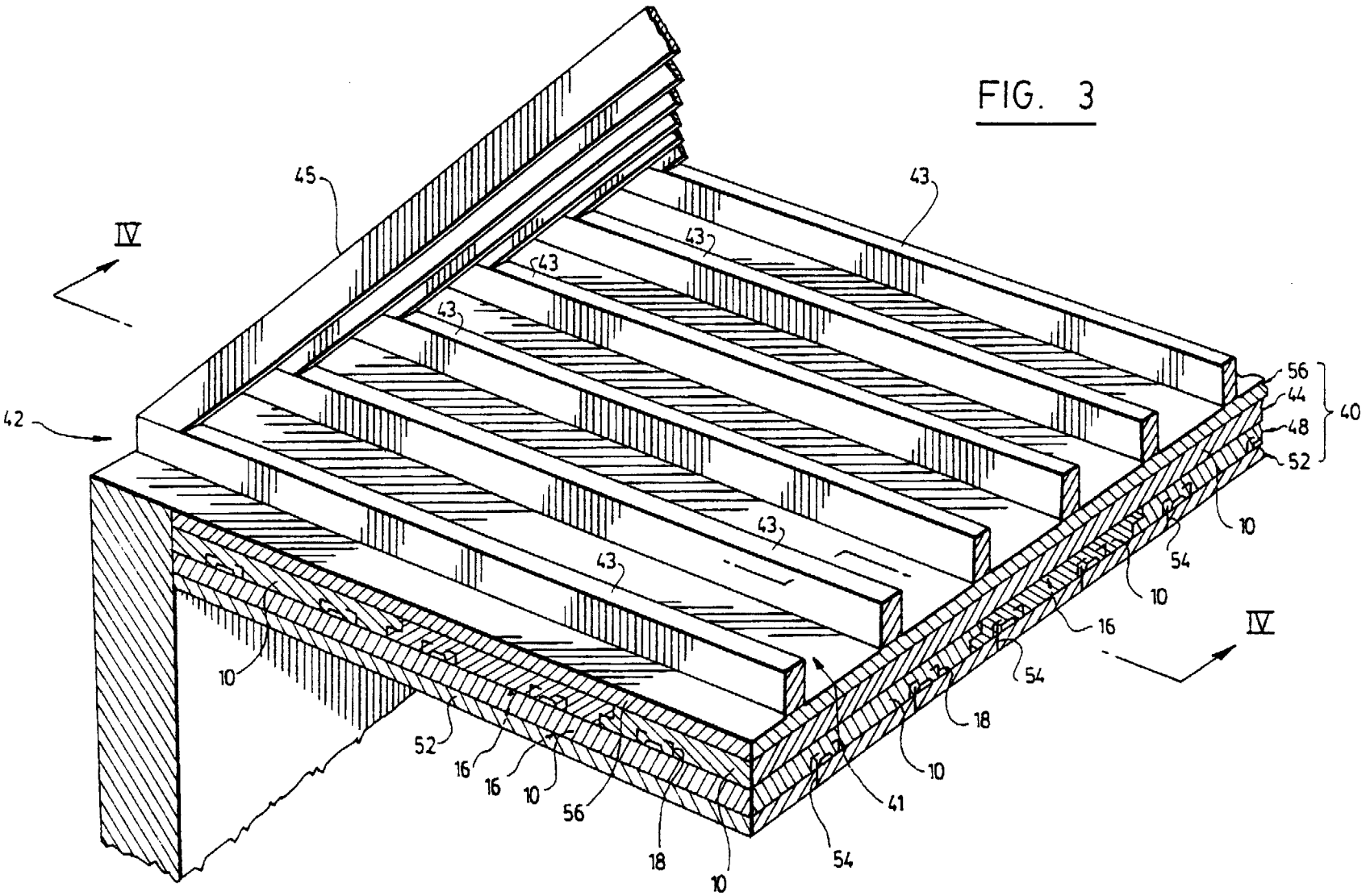
FIG. 3 is a perspective view of an insulating ceiling structure according to a preferred embodiment of the invention.
Figure 4:
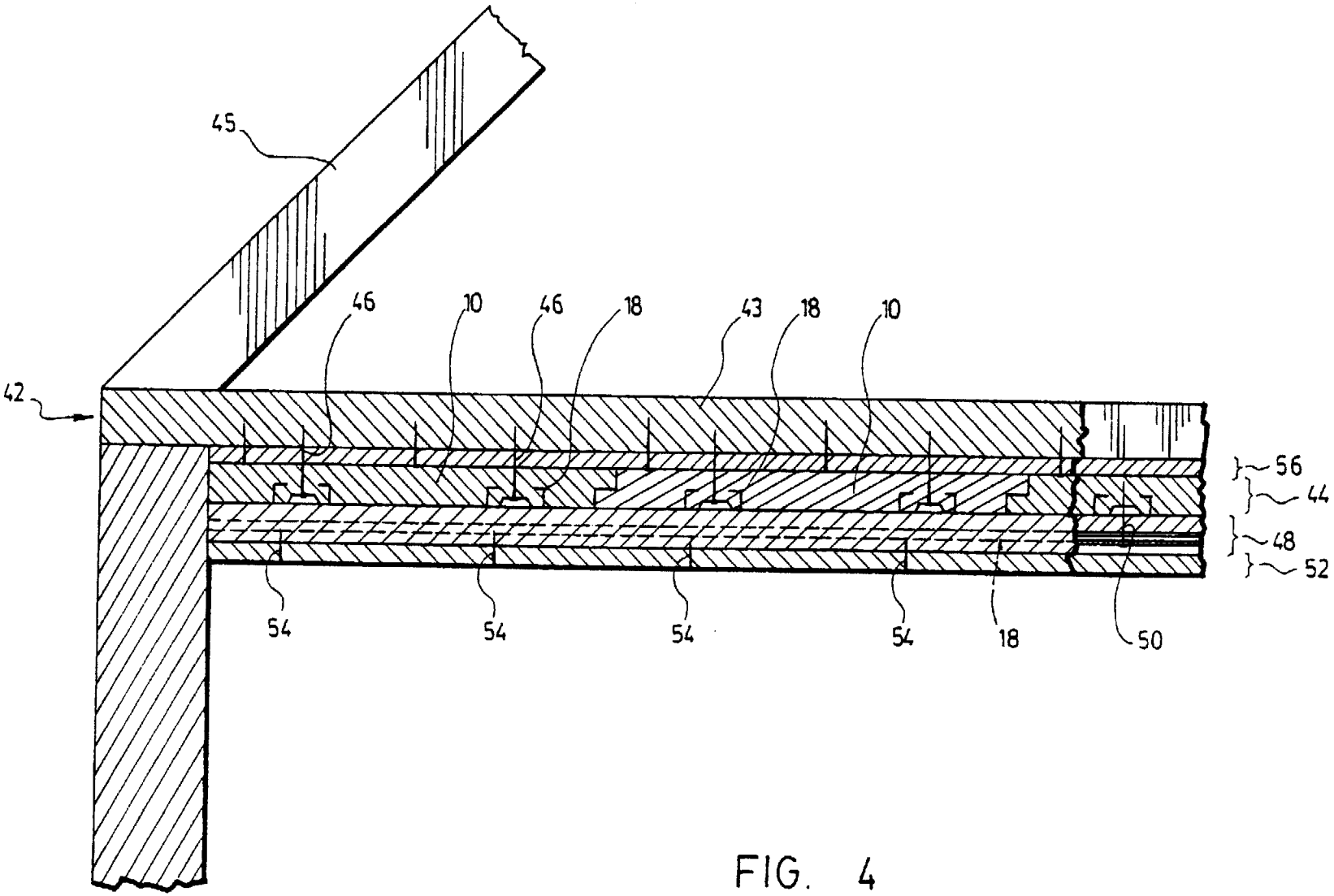
FIG. 4 is a cross-sectional view along line IV—IV of the insulating ceiling structure shown in FIG. 3.

Referring to FIGS. 3 and 4, an insulating structure is illustrated 40 therein for a ceiling 41 and for extending under the load-bearing structure 42 of a building. The load-bearing structure 42 comprises the ceiling joists 43 of the roof. FIG. 3 also shows the rafters 45 of the roof. The insulating ceiling structure 40, comprises a first layer 44 of insulating panels 10 as described hereinabove. Each panel is set such that its outer surface 16 having the bottom surface of each of the framing members 18 flush therewith is opposing the load-bearing structure 42. The insulating ceiling structure further comprises a first set of fasteners 46 for securing the panels 10 of the first layer 44 to the load-bearing structure 42 via the framing members 18.

Preferably, the insulating ceiling structure 40 further comprises a second layer 48 of panels 10 similar to the panels 10 of the first layer 44. Each panel of the second layer 48 is set such that its outer surface 16 having the bottom surface of the framing members 18 flush therewith is opposing the first layer 44 of panels. This insulating structure also comprises a second set of fasteners 50 for securing the panels 10 of the second layer 48 via the framing members 18 thereof to the framing members 18 of the first layer 44.

Preferably also, and as illustrated in FIGS. 3 and 4, the insulating ceiling structure 40 further comprises a layer of sheathing 52 comprising a plurality of sheathing panels, such as plaster board, for covering the second layer 48 of panels 10, and a third set of fasteners 54 for securing the sheathing panels 52 to the second layer 48 of panels 10 via the framing members 18 thereof.

The insulating ceiling structure 40 may further comprise an upper layer of panels 56 made of thin panels fixed to the load-bearing structure 42 between the load-bearing structure and the first layer of insulating panels 44. This upper layer 56 may have one or more functions, depending on the material they are made of. For example, they may serve as sound-proof or fire-proof protection. They may also help to keep the insulating panel flat and thereby prevent them from bulging. Preferably, this upper layer 56 comprises plywood sheets.

As can be appreciated, the insulating ceiling structure, as illustrated in FIGS. 3 and 4, prevents the formation of thermal bridges between the interior and the exterior of the room to be insulated. In fact, none of the fasteners go completely through the insulating structure, thereby preventing any direct thermal bridges between the interior and the exterior.

Of course, another preferred embodiment of an insulating ceiling structure of the present invention may comprise only one layer of insulating panels lying between an upper layer of plywood sheets and a layer of sheathing. Obviously, such an insulating ceiling structure would not have the same insulation capacity as the preferred embodiment shown in FIGS. 3 and 4.

Preferably, the first, second and third set of fasteners mentioned hereinbefore, comprises screws.

In order to better distribute the fasteners during the installation of the insulation panels 10, the framing members 18 of each insulating panel 10 should preferably be parallel with each other.

Moreover, in order to improve the insulation of the ceiling, the insulating panels 10 of the second layers 48 are disposed so that the framing members 18 thereof are perpendicular to the framing members 18 of the insulating panels 10 of the first layer 44, as shown in FIGS. 3 and 4. Such an arrangement of the panels further diminishes heat loss towards the exterior via the fasteners 46,50,54.

Method for building and insulating a ceiling structure

The method for building and insulating a ceiling structure under the load-bearing structure of a building comprises the step a), of fixing a first layer of insulated panels 44 as described hereinbefore, to the load-bearing structure 42. Each panel 10 is fixed to the load-bearing structure 42 by means of a first set of fasteners 46 inserted in the framing members 18 thereof. Each panel 10 is set such that its outer surface 16 having the bottom surface of the framing members 18 flush therewith is opposing the load-bearing structure 42.

Preferably, the method further comprises the step b), of fixing to the framing members 18 of the first layer 44, a second layer 48 of insulating panels 18 similar to the insulating panels 18 of the first layer 44. Each panel 10 of the second layer 48 is set such that its outer surface 16 having the bottom surface of the framing members 18 flush therewith is opposing the first layer of panels 44. Each panel 10 of the second layer 48 is fixed to a panel 10 of the first layer 44 by means of a second set of fasteners 50 inserted in the framing members 18 thereof. Preferably also, the method further comprises the step c), of fixing a layer of sheathing panels 52 to the second layer 48 of insulating panels 10. In this case, the sheathing panels 52 are fixed to the panels 10 of the second layer 48 with a third set of fasteners 54.

Preferably, the method further comprises the step of fixing an upper layer of plywood sheets 56 to the load-bearing structure 42, the upper layer 56 lying between the load-bearing structure 42 and the first layer of insulating panels 44.

Another method according to the present invention may comprise the steps of: a) fixing an upper layer of plywood sheets to the load-bearing structure, b) fixing a first layer of insulating panels under the upper layer and, c) fixing to the framing members of the first layer, a layer of sheathing comprising a plurality of sheathing panels for covering the first layer of panels 44. In this case, the sheathing panels are fixed to the panels 10 of the first layer by means of fasteners.

As can be appreciated, the insulating panels according to the present invention, allow to rapidly and easily build different versions of insulating structures, depending on the insulation degree required by simply adding a layer of insulating panels to the structure.

Although preferred embodiments of the invention have been described in detail herein and illustrated in the accompanying drawings, it is to be understood that the invention is not limited to this precise embodiment and that various changes and modifications may be made therein without departing from the scope or spirit of the invention.

I claim:

1. An insulating panel for a building structure, the panel comprising:

a rigid body made of thermoplastic foam;

two opposed outer surfaces; and a plurality of spaced-apart elongated framing members embedded in said body, each framing member having a U-shaped cross-section with a bottom surface parallel to both said outer surfaces and interconnecting a pair of oppositely disposed arms extending into the body, each of said arms being provided along the framing member with a plurality of holes filled with foam of the body and thereby anchoring said framing member in said body; and each of said bottom surface being adapted along its length to receive and hold a plurality of fasteners to secure the panel to the building structure and to hang and object to the panel.

2. An insulating panel as claimed in claim 1, wherein the bottom surface of each framing member is flush with one of said outer surfaces of the panel.

3. An insulating panel as claimed in claim 2, wherein the bottom surface of each framing member is provided with an elongated slot adapted to receive said at least one fastener.

4. An insulating ceiling structure for installation under a load-bearing structure of a building, the insulating ceiling structure comprising:

a first layer of panels as claimed in claim 2, the bottom surface of the framing members of each of said panels opposing the load-bearing structure; and a first set of fasteners for securing the panels of the first layer to the load-bearing structure via the framing members.

5. An insulating ceiling structure as claimed in claim 4, further comprising:

a second layer of panels similar to the panels of the first layer, the bottom surface of the framing members of each of said panels of the second layer opposing the first layer of panels; and a second set of fasteners for securing the panels of the second layer via the framing members thereof to the framing members of the first layer.

6. An insulating ceiling structure as claimed in claim 5, further comprising:

a layer of sheathing comprising a plurality of sheathing panels for covering the second layer of panels; and a third set of fasteners for securing said sheathing panels to the second layer via the framing members thereof.

7. An insulating ceiling structure as claimed in claim 6, further comprising:

an upper layer of plywood sheet lying between the load-bearing structure and the first layer of panels.

8. An insulating ceiling structure as claimed in claim 7, wherein, the framing members of each insulating panels are parallel with each other.

9. An insulating ceiling structure as claimed in claim 8, wherein the insulating panels of the second layer are disposed so that the framing members thereof are perpendicular to the framing members of the panels of the first layer.

10. An insulating ceiling structure as claimed in claim 9, wherein the first, second and third set of fasteners consist of screws.

11. An insulating ceiling structure as claimed in claim 4, further comprising:

an upper layer of plywood sheet lying between the load-bearing structure and the first layer of insulating panels;

a layer of sheathing comprising a plurality of sheathing panels for covering the first layer of insulating panels; and another set of fasteners for securing said sheathing panels to the first layer of panels via the framing members thereof.

12. A method for building and insulating a ceiling structure under a load-bearing structure of a building, the method comprising the step of:

a) fixing a first layer of insulating panels as claimed in claim 2 to the load-bearing structure by means of a first set of fasteners inserted in the framing members of the panels, the bottom surface of the framing members of each of said panels opposing the load-bearing structure.

13. A method as claimed in claim 12, further comprising the step of:

b) fixing to the framing members of the first layer a second layer of insulating panels similar to the insulating panels of the first layer by means of a second set of fasteners inserted in the framing members of the panels of the second layer, the bottom surface of the framing members of each of said panels of the second layer opposing the first layer of panels.

14. A method as claimed in claim 13, further comprising the step of:

c) fixing a layer of sheathing panels to the second layer of insulating panels; and before step a), fixing an upper layer of plywood sheet to the load-bearing structure, the upper layer lying between the load-bearing structure and the first layer of insulating panels.

* * * * *